United States Patent [19]

Chromy

[11] 4,064,949

[45] Dec. 27, 1977

[54] ELECTROPNEUMATIC HAMMER

[75] Inventor: Franz Chromy, Feldkirch-Levis, Austria

[73] Assignee: Hilti Aktiengesellschaft, Schaan, Liechtenstein

[21] Appl. No.: 722,028

[22] Filed: Sept. 10, 1976

[30] Foreign Application Priority Data

Sept. 12, 1975 Germany ..... 2540838

[51] Int. Cl.[2] ..... E21C 3/00

[52] U.S. Cl. ..... 173/14; 173/116

[58] Field of Search ..... 173/13, 14, 116, 118

[56] References Cited

U.S. PATENT DOCUMENTS

| | | | |
|---|---|---|---|
| 974,267 | 11/1910 | Hennessy et al. | 173/116 |
| 2,260,070 | 10/1941 | Wilhide | 173/13 |
| 2,260,172 | 10/1941 | Decker | 173/13 |
| 3,741,317 | 6/1973 | Unterschweiger et al. | 173/116 X |
| 3,841,418 | 10/1974 | Biersack | 173/13 X |
| 3,921,729 | 11/1975 | Schmuck | 173/14 |

FOREIGN PATENT DOCUMENTS

| | | | |
|---|---|---|---|
| 1,283,769 | 11/1968 | Germany | 173/13 |

*Primary Examiner*—Lawrence J. Staab

*Attorney, Agent, or Firm*—Toren, McGeady and Stanger

[57] ABSTRACT

In an electropneumatic hammer including an exciter piston and a percussion piston reciprocally displaceable within the bore of a guide cylinder, a sleeve-like clamping member is secured in an axially stationary position within the bore of the guide cylinder with the percussion piston passing through the clamping member. If there is no tool in the hammer and under certain other operating conditions, an axially displaceable tubular member located within the bore and laterally enclosing the clamping member, presses the clamping member inwardly into gripping contact with the percussion piston.

12 Claims, 3 Drawing Figures

ELECTROPNEUMATIC HAMMER

SUMMARY OF THE INVENTION

The present invention is directed to an electropneumatic hammer with an exciter piston and a percussion piston mounted within the bore in a guide cylinder and with a clamping member positioned within the guide cylinder for gripping the percussion piston under certain conditions.

In known percussion drills and chisels of the type employing an electropneumatic effect, the percussive energy is transmitted to the tool via a percussion piston. Accordingly, the tool or a holder for securing the tool can be chucked into a seat in the device. This arrangement positions the rear shank area of the tool or the tool holder in the striking range of the percussion piston or of an adapter which transmits the driving energy.

Particularly for reasons of wear, hammer drills should be designed so that the percussive or driving energy is transmitted to the tool shank or the holder for the tool shank only when the tool is in contact with the material to be worked. For example, hammers are known in which the tool or its holder is disposed in the chuck of the driving member so that it is axially movable. The amount which the tool or its holder can move axially is selected so that the end of the tool is located in the striking range of the percussion or driving piston or in the range of an adapter which transmits the energy when the tool is pressed into the tool seat or chuck by being pressed into contact with the material being worked.

When the driving piston can not transmit its energy to the tool, the energy has to be absorbed solely by components on the driving device. Under such circumstances considerable wear may occur and, in extreme cases, even the destruction of the driving device may take place, accordingly, known drill hammers include members which serve to intercept the driving piston for preventing its continuous operation when the energy is not transmitted through the tool to the material being worked.

One widely used device for intercepting the driving piston consists of a radially expandable clamping ring located in the path of the driven piston when the tool is no longer in contact with the material being worked so that the ring engages a shank portion of the piston. The percussion or driving piston is held by the natural elasticity of the clamping ring until the shank of the tool or the tool holder displaces the piston out of engagement with the ring when the tool is pressed against the material being worked. When this takes place, the driving piston can resume its normal operation unhindered.

In solving the problem of the interception of the driving piston, there is the significant disadvantage that, due to the need for axial movement, guide cylinders, the tool chuck on the driving device and the shank on the tool or the tool holder must be of great structural length. The structural length of these components causes the overall structural length of the drill hammer to be increased which, in addition to an increase in weight, also leads to considerable loads being placed on the front end of the device. The clamping ring itself is disadvantageous because the force available for braking and gripping the driving piston depends exclusively on the ring's natural elasticity. Due to the abrupt insertion of the piston into the ring, the ring is subjected to high stresses causing early fatigue and loss of its clamping or gripping power. Experience has shown that after a relatively short period of use the ability of the ring to grip the piston has deteriorated to the point where the weight of the tool or its holder alone suffices to permit the piston to slide out of the ring.

It is a primary object of the present invention to provide a hammer drill of the type described above which embodies an effective and structurally advantageous clamping member for the percussion or driving piston.

In accordance with the present invention, the problem is solved by providing a clamping member fixed in the axial direction relative to the guide cylinder through which the piston reciprocates with the piston passing through the clamping member during normal operation and with the clamping member being arranged to grip the peripheral surface of the piston when the tool is not pressed against the surface to be worked.

The clamping member has an axially extending passage or opening through which the driving piston reciprocates and the cross-sectional area of the opening or passage is preferably the same as or greater than the cross-sectional area of the piston moving through it. This feature affords a free sliding movement of the piston relative to the member. The action of lifting the tool from the material being worked is preferably utilized for actuating the gripping action of the clamping member. Consequently, the gripping action is not due to any inherent characteristic of the member and for this reason it is not exposed to fatigue. The result of the use of the clamping member is a virtually unlimited operating capability.

Based on the invention there is the beneficial effect on the structural length of the driving device and on the tool because the driving piston penetrates the clamping member at all times and can be clamped or gripped in the range of its reciprocating stroke. Accordingly, additional travel by the driving piston outside of its normal path to reach the clamping position is unnecessary. The solution afforded by the invention can be used in driving devices with and without a rotary drive.

The clamping member may be formed of several jaws, though an axially slotted ring could serve as well as the clamping member. For the achievement of the largest possible clamping surface and to limit the wear due to abrasion, it is preferable to provide the clamping member in the form of a bushing or sleeve-like member. Moreover, a bushing a sleeve-like member assures operability without susceptibility to trouble.

Pressing the bushing or sleeve-like member through which the driving piston passes, against the surface of the piston can be effected in a simple manner, for example, by making the bushing out of an elastic material. To assure that the bushing or sleeve-like member can also be greatly stressed, however, it is expedient if it is formed of steel and in one preferrred embodiment the member has axially or longitudinally extending slots to assure radial displaceability and, as a result, a particularly effective gripping action on the driving piston. The axially extending slots may only extend over a portion of the length of the bushing. In such an arrangement, the unslotted length of the bushing faces toward the exciter piston and serves as a guide for the shank of the driving piston.

In another embodiment of the invention, the sleeve-like member extends through a tubular member which is movable in an axial direction and the outside diameter of the sleeve-like member more remote from the exciter piston is greater in the area in which it passes through the tubular member than the inside diameter of the tubular member facing toward the exciter piston. In this arrangement at least one of the parts has a continuously tapering surface, suchh as a frusto-conical surface converging toward the exciter piston. With the tubular member having a tapered inside diameter sliding on a portion of the sleeve-like member having a larger outside diameter when the tubular member is moved axially from the exciter piston, there occurs a radially inwardly directed pressing action of the sleeve-like member against the shank of the driving piston inhibiting the piston's reciprocating motion.

A portion of the inside surface of the tubular member tapers continuously inwardly toward the exciter piston and the outer surface of the sleeve-like member more remote from the exciter piston has an annular "run-up" shoulder which provides an increased diameter on the outside of the sleeve-like member. These two variable diameter surfaces are located adjacent one another and if the tubular member is moved axially away from the exciter piston, the "run-up" shoulder on the sleeve-like member will ride on the inwardly tapering surface of the tubular member causing the inside surface of the sleeve-like member to move radially inwardly into gripping contact with the shank of the driving piston. In the clamped position, in the range of the "run-up" shoulder area on the sleeve-like member there will develop a tight partial clamping action by the sleeve-like member providing a strong local clamping or gripping action on the piston with the exertion of a relatively small amount of force.

It is also possible, however, to configure the sleeve-like member to taper continuously inwardly in the direction of the exciter piston and to provide on the tubular member closer to the exciter piston an annular "run-up" shoulder which has the shape of a tapering inside surface of the tubular member.

Another feature of the invention is the provision of a cylindrically shaped portion in axi-parallel relation with the driving piston and adjoining the smaller diameter end of the tapering surface on the tubular member. After the tubular member has been displaced axially away from the exciter piston and the highest clamping force has been developed, the "run-up" shoulder on the bushing or sleeve-like member arrives in the range of the axi-parallel cylindrically shaped surface for preventing the tubular member from moving back toward the exciter piston by itself. Therefore, a safety action is provided against any undesired movement of the tubular member out of the position where the maximum clamping force is reached. To provide for a holding action in this position, it is also possible to provide a snap-in groove for the "run-up" shoulder in the range of the axi-parallel cylindrically shaped surface of the tubular member.

On the other hand, if a large contact area for pressing the sleeve-like member against the shank of the driving piston is desired, it is advantageous if both the tubular member and the sleeve-like member in the area where they telescope have continuously tapering surfaces converging in the direction toward the exciter piston. To attain a continuous clamping process it is expedient if the tapering surfaces have a frusto-conical configuration.

In one embodiment, the tubular member has a driver extending across the path of movement of the driving piston. This driver causes the tubular member to be moved away from the exciter piston by the driving piston when the tool shank or tool holder shank is not pressed toward the driving piston, that is, the driving piston strikes the driver and effects its own clamping action without striking other components of the apparatus and causing any damage.

While a pin or ring is suitable for use as the driver, it is advantageous if a buffer plate is used either as a separate member or as an integral part of the tubular member. In addition to its great impact absorptivity, the buffer plate also has the advantage of providing a direct seal between the impact area of the driving piston and the base or contact area of the tool.

Still another feature of the invention is to provide a power source which biases the tubular member axially away from the exciter piston and assures fatigueless, automatic clamping of the driving piston shank in any operating position of the driving piston.

Though a rubber part is suitable for use as the power source it is more advantageous to use a spring, and particular a compression spring which is characterized, as experience has shown, by its good functional properties and long life.

The various features of novelty which characterize the invention are pointed out with particularity in the claims annexed to and forming a prt of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
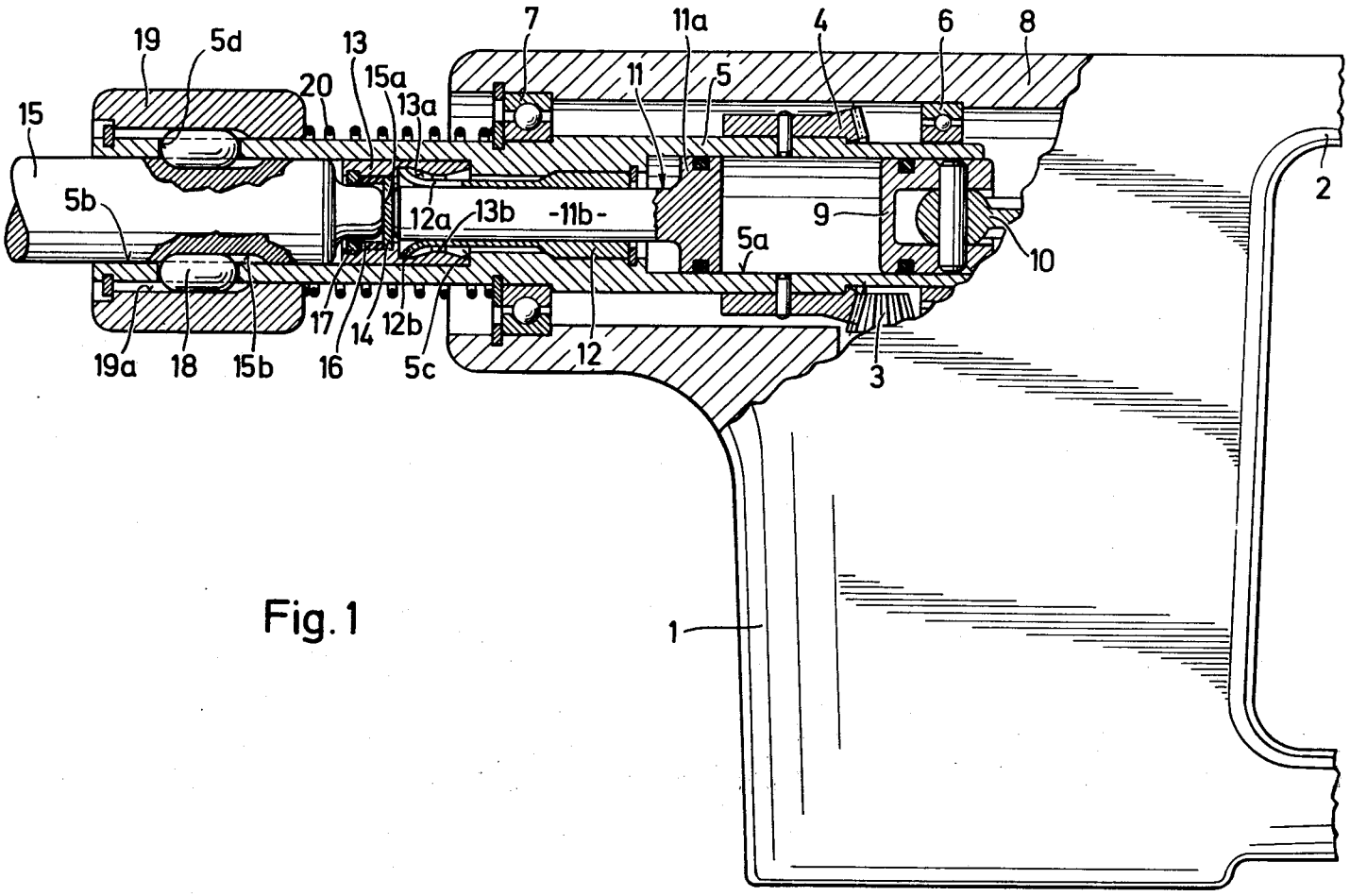
FIG. 1 is a side view, partly in section, of a hammer drill embodying the present invention and illustrated in the operating position and without its handle.

In FIG. 1 a hammer drill is illustrated including a motor housing 1 with a handle 2, only partly shown, attached to it. Within the motor housing a double gear 4, fixed to a guide cylinder 5, is driven by a double pinion 3. The guide cylinder 5 is mounted within and extends axially through a housing 8. At its rear end within the housing 8, the guide cylinder 5 is supported within a ball bearing 6 and it is also supported intermediate its rear and front ends by another ball bearing 7 so that it can rotate within the housing but does not shift in the axial direction. The bore through the guide cylinder has a rear bore section **5*a* of greater diameter than the bore section extending forwardly from it. Axially movable mounted within the rear bore section 5*a* is an exciter piston 9 which forms a reciprocating motion under the action of a piston rod 10 which is only partly shown. Spaced forwardly of the exciter piston within the rear bore section 5*a* is the enlarged head 11*a* of an axially movable percussion or driving piston 11 which has a reduced diameter shank 11*b* extending forwardly through the reduced diameter bore section of the guide cylinder. When the exciter piston 9 is reciprocated, the driving piston undergoes a corresponding reciprocating motion due to an air cushion located between the forward end of the exciter piston and the rear end of the driving piston. Within the reduced diameter section of the bore through the guide cylinder 5, a bushing or sleeve-like member 12 laterally encloses the shank 11***b* of the driving piston and acts as a clamping member. The sleeve-like member 12 is secured within the guide cylinder 5 so that it can not move in the axial direction. Several axially or longitudinally extending slots 12*a* are provided in the sleeve-like member 12 extending from its forward end toward its rearward end for enhancing the radial displaceability of the portion of the member containing the slots. The slotted length of the sleeve-like member 12 is laterally enclosed by a tubular member 13 which is axially displaceable within a front bore section 5*b* in the guide cylinder 5. The front bore section 5*b* also provides a seat or chuck for a tool inserted into the front end of the guide cylinder. In the axial length of the telescoping portions of the sleeve-like member 12 and the tubular member 13, the inside wall of the tubular member is in positive contact with the outside diameter of the sleeve-like member and this contact is provided at the end of the sleeve-like member 12 more remote from the exciter piston 9 by a "run-up" shoulder 12*b* which affords an increased outside diameter on the member. This shoulder 12*b* provides an annular bead which slides along the inside wall or surface of the tubular member 13 when the tubular member is displaced axially away from the exciter piston. The inside wall of the tubular member 13 has a tapered contour 13*a* converging inwardly in the direction toward the exciter piston 9 and at the smaller diameter end of the tapered surface there is a cylindrical section 13*b* whose surfaces are axi-parallel with the axis of the driving piston 11.

Forwardly of the end of the driving piston shank 11*b* more remote from the exciter piston 9 is a buffer plate 14 mounted within and extending transversely of the tubular member 13. The buffer plate blocks the passage of the shank 11*b* and its purpose, in addition to providing a sealing function, is to transmit the kinetic energy of the driving piston 11 to a tool 15 mounted in the front bore section 5*b*.

If a tool 15 is positioned in the hammer drill, and if it is pushed against the buffer plate 14 by pressing it against a material on which work is to be effected, as shown, the tubular member 13 is maintained against a stop shoulder 5*c* formed at the junction between the front bore section 5*b* and the reduced diameter bore section which spaces it from the rear bore section 5*a*. In this operating position, the "run-up" shoulder 12*b* is at the largest diameter end of the tapering contour 13*a* on the inner surface of the jacket member 13 so that there is no interference with the axial displaceability of the shank 11*b* nor of the overall driving piston 11.

If, on the other hand, there is no tool 15 in the tool chuck of the hammer drill or if the tool 15 has slipped off the material being worked during the course of operation of the drill, the rear end 15*a* of the tool 15, facing toward the driving piston 11, releases the tubular member for movement in the forward direction, that is toward the tool 15. Regardless of this displacement, the driving piston 11 continues to move back and forth striking the buffer plate 14 which is then displaced in the direction toward the tool 15 and taking the tubular member 13 along with it. This displacement of the tubular member 13 causes a relative movement of the tubular member with respect to the stationary clamping sleeve-like member 12. Accordingly, the "run-up" shoulder 12*b* on the front end of the sleeve-like member slides along the frusto-conically shaped tapering surface 13*a* so that the axially extending portions of the sleeve-like member 12 between its slots 12*a* are displaced radially inwardly and pressed against the shank 11*b* clamping the driving piston and discontinuing its reciprocating action. The tubular member 12 moves in the direction of the tool 15 until the "run-up" shoulder 12*b* reaches the range of the cylindrically shaped surface 13*b* which is in axi-parallel relation with the driving piston 11. In this position the tubular member 13 stops its axial movement and the sleeve-like member 12 maintains its clamping or gripping action on the driving piston.

If the tool 15 is again pressed against the material being worked, the buffer plate 14 along with the tubular member 13 moves in the rearward direction toward the exciter piston 9 releasing the gripping effect of the sleeve-like member on the driving piston.

To insure that the buffer plate 14 when it is under load will not damage the tubular member 13, the tubular member is supported by a lock washer 17 and a damper ring 16.

The tool 15 is retained in its chuck or seat by means of rollers 18 mounted within slots 5*d* formed through the guide cylinder 5 with the rollers held against movement in the axial direction and extending into grooves 15*b* in the surface of the tool and also into safety grooves 19*a* in the inner surface of a locking collar 19. The grooves 15*b* are longer in the axial direction of the drill than the rollers 18, thereby affording a limited axial movement of the tool within its seat in the front end of the drill. A compression spring 20 laterally encloses the guide cylinder 5 between the rear end of the collar 19 and the front end of the ball bearing 7 biasing the collar toward the front end of the drill and preventing the release of the rollers 18.

Figures 2, 3:
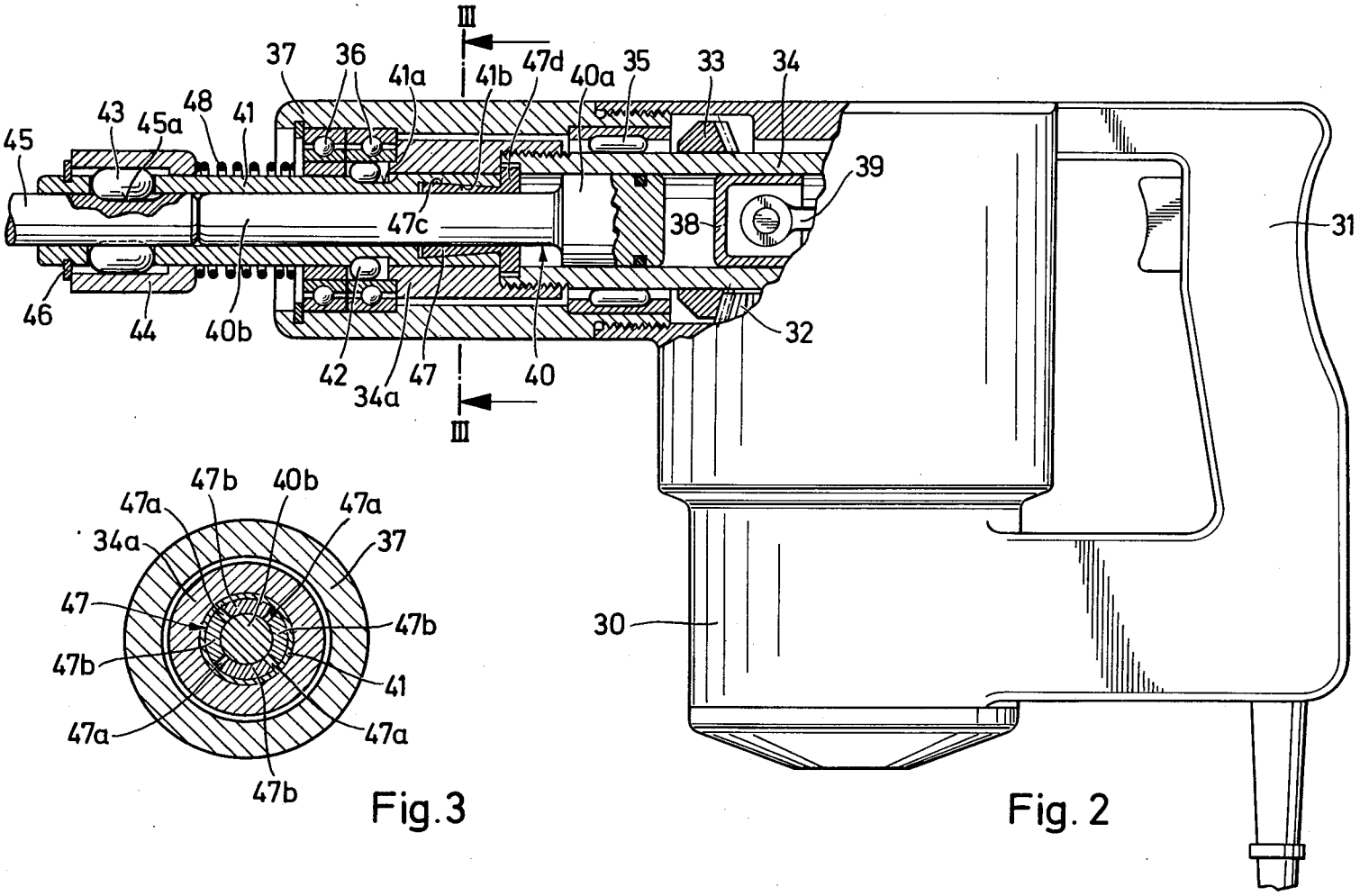
FIG. 2 is a view similar to FIG. 1 showing another embodiment of a hammer drill in the operating position.
FIG. 3 is a transverse section taken along the line III—III of FIG. 2.

In another embodiment of the invention illustrated in FIG. 2, a drill hammer includes a motor housing 30 to which a handle 31 is attached. A bevel pinion 32 located within the motor housing and shown in part, drives a double gear 33 which is fixed on a guide cylinder 34 extending axially through a housing 37. A front part 34*a* is threaded on to the guide cylinder 34 for production and assembly reasons. The complete guide cylinder 34, 34*a* is rotatably mounted in the housing 37 by means of a roller bearing 35 located about the rearward portion of the guide cylinder and by a ball bearing 36 located in the forward portion of the housing at the forward end of the front part 34*a*. Axially movably positioned within the guide cylinder 34 is an exciter piston 38 which is reciprocated by a connecting rod 39 shown only in part. Spaced forwardly of the exciter piston within the guide cylinder 34 is a driving or percussion piston 40 which consists of an enlarged head disposed in sliding contact with the surfaces of the guide cylinder 34 and a reduced diameter shank 40*b* which extends forwardly from the guide cylinder into the front part 34*a*. Within the front part 34*a* the shank 40*b* extends axially through a tubular member 41. The front end of the tubular member 41 acts as a chuck or seat for a tool 45. To a limited extent, the tubular member is axially movable relative to the guide cylinder 34. Coupling rollers 42 engaged within the front part 34*a* of the guide cylinder 34 are in engagement with longitudinal grooves 41*a* in the tubular member assuring, on one hand, the limitation of the axial travel of the tubular member and, on the other hand, effecting the transmission of the rotary motion of the complete guide cylinder 34, 34*a* to the tubular member 41. The forward portion of the tubular member within which the tool is seated, has rollers 43 which are pressed inwardly by means of an axially movable locking collar 44 into transmission grooves 45*a* in the tool 45. It can be noted that the grooves in the tool are longer than the rollers 43 themselves. A lock washer 46 secured into the outer front end surface of the tubular member 41 secures the locking collar against displacement from the tubular member.

The end of the tubular member 41 closer to the exciter piston 38 has a counterbore 41*b* with a dovetailed appearance, note FIG. 2, that is, the inner surface of the counterbore tapers inwardly toward the exciter piston. The inner surface of the counterbore 41*b* has a frusto-conical configuration. Within this space defined radially inwardly by the shank 40*b* of the driving piston 40 and radially outwardly by the frusto-conical surface of the counterbore 41*b* is a bushing or sleeve-like member 47 which, as is shown in FIG. 3, is divided into individual axially extending segments 47*b* by axially extending slots 47*a*. The radially outer surface of the sleeve-like member 47 has a frusto-conical configuration 47*c* mating with the frusto-conical surface within the counterbore 41*b*. As with the surface within the counterbore, the radially outer surface of the sleeve-like member 47 taper inwardly in the direction toward the exciter piston. To prevent the bushing 47 from shifting axially relative to the guide cylinder, the sleeve-like member has a flange 47*d* at its rear end that is, the end closer to the exciter piston 38, which engages within an annular groove defined between the guide cylinder 34 and the front part 34*a* of the guide cylinder.

Extending helically about the outer surface of the tubular member 41 between the forward end of the front part 34*a* and the rearward end of the locking collar 44 is a spring 48 which pushes the tubular member forwardly, that is away from the exciter piston 38.

When the motor in the motor housing 30 is running, the bevel pinion 32 drives the bevel gear 33 which, in turn, rotates both the guide cylinder 34 and its front part 34*a*. The rotary motion is transmitted by the coupling rollers 42 to the tubular member 41 and then by means of the rollers 43 to the tool 45. At the same time, the connecting rod causes the exciter piston 38 to reciprocate. The driving piston 40 with its head 40*a* disposed within and in sealed contact with the guide cylinder 34 moves back and forth with the exciter piston 38 due to the air cushion provided between the rear end of the head 40*a* and the front end of the exciter piston 38. This reciprocating motion of the driving piston causes the front end of its shank 40*b* to contact the trailing end of the tool 45 shown within the tubular member 41. In FIG. 2 the driving piston and tool are shown in the operating position. Accordingly, the kinetic energy of the driving piston 40 is transmitted over the tool 45 to the material being worked.

For reasons of simplification, the various air equalizer holes usually provided for the build-up of the piston are neither shown nor described, since they are well known.

In the operating condition of the hammer drill, the pressure exerted against the tool 45 or on the front shoulder of the transmission groove 45*a* and on the rollers 43 causes the tubular member 41 to move backwardly toward the exciter piston 38, countering the force of the spring 48. Therefore, the frustoconical contours 41*b* and 47*c* of the tubular member 41 and the sleeve-like member 47, respectively, do not effect an inward pressing action of the sleeve-like member against the surface of the shank 40*b*.

If the hammer drill with the tool 45 is lifted off the material being worked with the rotating and driving systems operating, the tool can move forwardly in the tubular member 41 by means of the transmission groove 45*a*. Consequently, the tubular member is no longer held in its rear position and the spring displaces it in the forward direction. During this forward movement, the frusto-conical contours 41*b* and 47*c* of the tubular member 41 and the sleeve-like member 47, respectively, move relative to one another with the forward end of the sleeve-like member directed away from the exciter piston being pressed inwardly against the outside surface of the shank 40*b* into gripping or clamping contact with the shank and causing first a slow down and then finally the stopping of the movement of the driving piston 40.

The same clamping action also occurs if the tool 45 in this case a drill, is pulled out of the drill hole, or if no tool is placed into the chuck or seat in the device.

The solution provided by the present invention is particularly well suited for percussion or driving tools of the heavy duty class.

While specific embodiments of the invention have been shown and described in detail to illustrate the application of the inventive principles, it will be understood that the invention may be embodied otherwise without departing from such principles.

What is claimed is:

1. In an electropneumatic hammer comprising a housing, an axially extending guide cylinder within said housing, said guide cylinder forming an axially extending bore having a forward end and a rearward end, an exciter piston displaceably mounted within the bore in said guide cylinder, a driving piston displaceably mounted within the bore in said guide cylinder between said exciter piston and the forward end of the bore, wherein the improvement comprises an axially extending clamping member located within the bore with the axis thereof disposed in parallel relation with the axis of the bore and said clamping member secured against axial displacement in the bore, said clamping member having a first end and a second end with said second end spaced forwardly of said first end toward the forward end of said bore, said driving piston having a first part located adjacent to said exciter piston and a second part extending from said first part toward the forward end of the bore, said second part having an axially extending outer surface thereon arranged to be gripped by said clamping mamber and said surface extending through said clamping member from the first end toward the second end thereof as said driving piston reciprocates, and said clamping member having a portion thereof being inwardly movable relative to the axis of the bore through said guide cylinder under certain conditions for effecting gripping contact with the outer surface of the second part of said driving piston.

2. In an electropneumatic hammer, as set forth in claim 1, wherein said clamping member comprises an axially extending sleeve-like member.

3. In an electropneumatic hammer, as set forth in claim 2, wherein said sleeve-like member having axially extending slots therein for facilitating the inward movement of said member into gripping contact with the second part of said percussion of said driving piston.

4. In an electropneumatic hammer, as set forth in claim 3, wherein a tubular member being axially displaceably mounted within the bore in said guide cylinder, said sleeve-like member positioned within said tubular member, said sleeve-like member having a first part close to said exciter piston and a second part more remote from said exciter piston with said second part being located within said tubular member, said second part having at least a portion thereof with an outside diameter larger than the smallest inside diameter of the portion of said tubular member within which said second part of said sleeve member is located and at least an annular portion of one of said second part of said sleeve-like member and said portion of said tubular member within which said second part is located having a tapering configuration.

5. In an electropneumatic hammer, as set forth in claim 4, wherein the radially inner surface of the portion of said tubular member within which said second part of said sleeve-like member is located having a tapering surface converging in the direction toward said exciter piston and the radially outer surface of the second part of said sleeve-like member having a tapering portion diverging outwardly in the axial direction away from said exciter piston so that during axial displacement of said tubular member relative to said sleeve-like member the tapering surfaces thereon contact and effect a radially inwardly directed movement of said sleeve-like member into gripping contact with said driving piston.

6. In an electropneumatic hammer, as set forth in claim 5, wherein the radially inner surface of said tubular member within which said second part of said sleeve-like member is located having a cylindrical section extending axially from and having approximately the same diameter as the smaller diameter end of the tapering surface on said tubular member.

7. In an electropneumatic hammer, as set forth in claim 4, wherein an axially extending co-extensive portion of each of the radially inner surface of said tubular member and the radially outer surface of said sleeve-like member having a mating tapering configuration.

8. In an electropneumatic hammer, as set forth in claim 7, wherein said mating tapering configurations of said tubular member and said sleeve-like member being frusto-conically shaped.

9. In an electropneumatic hammer, as set forth in claim 4, including a driver mounted on said tubular member and extending transversely of the axis thereof and disposed in the path of said driving piston.

10. In an electropneumatic hammer, as set forth in claim 9, wherein said driver comprises a buffer plate extending across the opening through said tubular member and located closer to the forward end of said bore in said guide member than the end of said sleeve-like member which is closer to the forward end of said bore.

11. In an electropneumatic hammer, as set forth in claim 4, including means for biasing said tubular member in the axial direction away from said exciter piston.

12. In an electropneumatic hammer, as set forth in claim 11, wherein said means for biasing said tubular member comprises a helical spring laterally enclosing an axially extending portion of said tubular member.

* * * * *